United States Patent [19]

Jackson

[11] Patent Number: 4,576,370

[45] Date of Patent: Mar. 18, 1986

[54] METHOD AND APPARATUS FOR TIPPING CLOSELY INCIDENTAL MAIL TO MAGAZINES OR THE LIKE

[75] Inventor: Dale H. Jackson, Plattsburgh, N.Y.

[73] Assignee: Harris Graphics Corporation, Melbourne, Fla.

[21] Appl. No.: 685,712

[22] Filed: Dec. 24, 1984

[51] Int. Cl.[4] ..... B65H 39/02

[52] U.S. Cl. ..... 270/54; 270/58; 364/478; 364/900; 156/355; 156/387

[58] Field of Search ..... 270/54–56, 270/58, 52; 271/3, 3.1, 4; 235/375; 364/464, 478, 200, 900; 156/354–355, 351, 384, 387, 388; 229/92, 92.1; 53/493, 505

[56] References Cited

U.S. PATENT DOCUMENTS

| | | | |
|---|---|---|---|
| 3,891,492 | 6/1975 | Watson | 270/54 |
| 3,899,165 | 8/1975 | Abram et al. | 270/58 |
| 3,917,252 | 11/1975 | Harder et al. | 270/58 |
| 4,022,455 | 5/1977 | Newsome et al. | 270/54 |
| 4,033,807 | 7/1977 | Neill et al. | 156/384 |
| 4,384,196 | 5/1983 | McCumber et al. | 235/375 |
| 4,484,733 | 11/1984 | Loos et al. | 270/54 |
| 4,500,083 | 2/1985 | Wong | 270/58 |
| 4,517,650 | 5/1985 | Gomes et al. | 364/478 |
| 4,525,788 | 6/1985 | Gottlieb et al. | 270/58 X |
| 4,527,791 | 7/1985 | Piotroski | 270/58 |

*Primary Examiner*—E. M. Eickholt

*Attorney, Agent, or Firm*—Yount & Tarolli

[57] ABSTRACT

A method and apparatus are disclosed for automatically tipping closely incidental mail to magazines or the like. A plurality of magazines are sequentially fed from a source location to a town sort stacking location. A labelling station and an envelope tipping station are disposed intermediate the source and town sort location. Presorted closely incidental mail pieces are provided and scanned for zip code information. Labels are provided having subscriber information including name, address, zip code and mail piece attachment indicia indicating whether that subscriber is to receive a mail piece. Each label is scanned. If a label scanned does not include mail piece attachment indicia indicating that subscriber is to receive a mail piece, that label is fixed to the corresponding, next magazine being fed from the source location to the town sort stack location. If a label scanned does include mail piece attachment indicia indicating that subscriber is to receive a mail piece, the zip code of that label is compared to the zip code of the next to feed closely incidental mail piece. If the zip codes match, the closely incidental mail piece is tipped to the corresponding next magazine being fed from the source location to the town sort stack location and that label is discarded. If a label scanned includes mail piece attachment indicia indicating that subscriber is to receive a mail piece but the zip code of the subscriber information on that label does not match the zip code of the next to feed closely incidental mail piece, an error signal is generated.

17 Claims, 5 Drawing Figures

METHOD AND APPARATUS FOR TIPPING CLOSELY INCIDENTAL MAIL TO MAGAZINES OR THE LIKE

TECHNICAL FIELD

The present invention relates to a method and apparatus for collating attachments with magazines and is particularly directed to a method and apparatus for tipping closely incidental mail pieces to selected magazines in a group of magazines being fed from a source location to a town sort station.

BACKGROUND ART

It is common practice in the publication industry to attach a mailing label to the exterior cover of a publication to be mailed. The labels include subscriber information, including the subscriber's name, address and zip code. After the labels are affixed to the publications, they are ready for mailing. The publisher pays the postal system for each publication mailed.

Certain periodic publications have a large number of subscribers. The total amount of postage paid for such widely distributed publications can be quite substantial. Periodic publications such as magazines enjoy the benefit of reduced postal rates because of the quantity of magazines mailed. A publisher can benefit from further reduced postal expenditures by presorting the publications prior to mailing according to geographic areas and in particular, according to zip codes areas.

A publisher incurs further postal expenses because of other business activities related to the publications it mails. For example, a publisher of a periodic publication may wish to communicate by letter with certain of the publication's subscribers. This practice is common for communications such as renewal notices. In any particular publication period, a certain number of subscribers will be approaching the end of their individual subscription period. The publisher, of course, keeps careful track of each subscriber's subscription period. Prior to reaching the end of a subscriber's subscription period, the publisher typically sends a letter to the subscriber offering him a reduced rate to renew his subscription at that time.

Often, a subscriber will not respond to the publisher's first renewal letter. A subscriber's failure to respond to the first renewal letter will typically result in the publisher sending another letter containing a reminder that the subscriber's subscription is about to lapse and that the subscriber should renew his subscription. The first renewal letter and subsequent follow-up renewal letters are typically sent prior to the actual date of the end of the subscription period to permit the subscriber time to renew his subscription without a lapse in service.

Since subscribers' subscriptions typically expire at different times, the publisher needs to send the renewal notices to subscribers on an individual basis. A renewal notice in the form of a letter is far preferable over a non-personalized renewal card inserted into the magazine.

Beside the renewal letter, a publisher may have various other reasons for wanting to communicate to its subscribers by letter. Often, publishers wish to solicit a variety of information from their subscribers, such as yearly income, profession, etc. This information is referred to as demographic data and is useful to the publisher for advertising purposes. A publisher may solicit such demographic data from its subscribers by mailing letters containing questionnaires. Based on the demographic data provided by subscribers, a publisher may wish to communicate some special offer, by letter, to certain subscribers having common demographic data.

The postal charge to publishers for mailing letters to subscribers is approximately equal to the first class postage rate at the time of mailing. The publisher may enjoy a slightly reduced rate because of the quantity of letters mailed or by presorting the letters. If a particular publication has a substantial number of subscribers, the cost of renewal and other types of letters mailed by the publisher is substantial.

Postal regulations have been suggested that would permit a publisher to attach a letter, such as a renewal letter, to the exterior of a publication and not have to pay any additional postage for the letter. Such letters are referred to as closely incidental mail. The savings of postage to a publisher for such closely incidental mail would be quite substantial.

SUMMARY OF THE INVENTION

The present invention provides a method and apparatus for automatically tipping closely incidental mail pieces to certain publications without disrupting the production of the publications.

In a preferred embodiment of the present invention, an apparatus for tipping closely incidental mail to magazines or the like includes a first scanner that scans presorted mail pieces having machine readable subscriber information thereon including geographic indicia. The first scanner generates an electrical signal indicative of the geographic indicia on each mail piece. A controller stores the information from the scanner in a first storage means. A mail piece storage means stores the mail pieces in their scanned order. Conveyor means sequentially transports a plurality of publications from a source location to a town sort station. A label feeding means and a mail piece feeding station are positioned intermediate the source location and the town sort station. The label feeding means provides labels with subscriber information thereon having a subscriber's name, address, zip code, and mail piece attachment indicia indicating whether that subscriber is to receive a mail piece. A second scanner scans each label and generates a signal to the controller indicative of the subscriber's zip code and mail piece attachment indicia. The controller determines if the subscriber information on a scanned label includes mail piece attachment indicia indicating that subscriber is to receive a mail piece. The label is attached to a publication being transported when the controller determines the subscriber information on that label does not contain mail piece attachment indicia indicating that subscriber is to receive a mail piece. If the subscriber information on a scanned label does include mail piece attachment indicia indicating that subscriber is to receive a mail piece, the controller then determines if the geographic indicia of a next to feed incidental mail piece is the same as the geographic indicia that was on the scanned label. If the geographic data coincides, the controller commands the mail piece feeding station to tip the next to feed mail piece to the subscriber's publication corresponding to that label as that publication passes the mail piece feeding station.

A conveyor position sensor is provided to synchronize the label feeding station and the mail piece feeding station with the movement of the conveyor so that the labels and mail pieces are properly fed to the passing publications. Alignment pins are provided on the conveyor to retain the publications in a known position on the conveyor.

In another embodiment, the label station includes a label printer which may take the form of an ink jet printer. The controller has subscriber information stored in a second storage means for each subscriber of the publication including the subscriber's name, address, zip code and mail piece attachment indicia. When the controller retrieves a subscriber's information from its second storage means, it determines whether the retrieved subscriber information includes mail piece attachment indicia indicating that subscriber is to receive a mail piece. If the retrieved subscriber information does not include mail piece attachment indicia indicating that subscriber is to receive a mail piece, the controller will enable the label printer to print a label either directly on the publication or indirectly onto a separate label which is subsequently attached to the publication by a label feeding station. When the controller determines that the mail piece attachment indicia indicates that subscriber is to receive a mail piece, the controller then determines whether the subscriber's zip code is the same as the zip code of the next to feed mail piece. If the zip codes match, the next to feed mail piece is tipped onto the subscriber's publication as it passes the mail piece feeding station.

In accordance with the method of the present invention, presorted, mail pieces are provided, the pieces being presorted into groups according to geographic regions. Each mail piece has machine readable subscriber information thereon, including geographic indicia. Subscriber labelling information is provided including the subscriber's name, address, geographic indicia, and mail piece attachment indicia indicating whether that subscriber is to receive a mail piece. The subscriber information for a next publication is examined. If the examined subscriber labelling information includes mail piece attachment indicia indicating that subscriber is to receive a mail piece, the geographic region of the next to feed mail piece is compared to the geographic region of the examined subscriber labelling information. A mail piece is tipped to the next passing publication if (i) the examined subscriber information included mail piece attachment indicia indicating that subscriber is to receive a mail piece and (ii) the geographic region of the next to feed mail piece is the same as the geographic region of the examined subscriber information. If the examined subscriber information does not include mail piece attachment indicia indicating that subscriber is to receive a mail piece, the subscriber information is placed upon a publication.

BRIEF DESCRIPTION OF THE DRAWINGS

Other features and advantages of the invention will be apparent to those skilled in the art by a reference to the following detailed description taken in connection with the accompanying drawings wherein.

DETAILED DESCRIPTION

Figure 1:
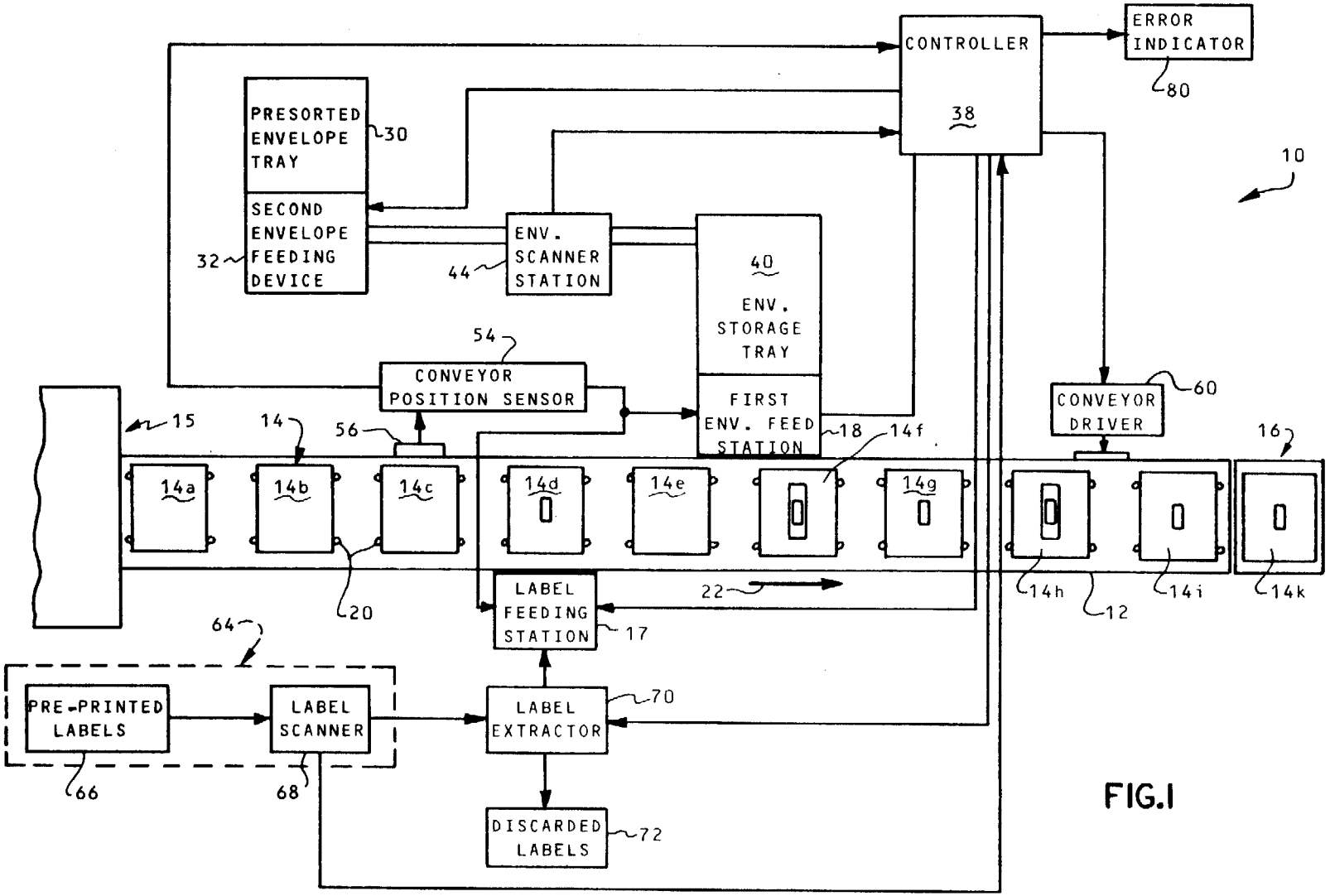
FIG. 1 is a schematic illustration of an automatic, mail piece tipping apparatus in accordance with the present invention.

In the following specification and claims it is to be understood that the words "magazine" and "publication" are used to denote any material assembled from a plurality of signatures including, but not limited to journals, periodicals, catalogs, directories, books and pamphlets. The word "tipping" is defined as the attachment of a card, envelope or the like to the exterior of a magazine in such a manner that it can be easily removed by a subscriber.

A closely incidental mail piece tipping apparatus 10 includes a conveyor 12 carrying a plurality of magazines 14 from a source location 15 to a town sort stacking station 16. The magazines 14 have been completely assembled by the time they approach the town sort station. Intermediate the source location and the town sort station is a label feeding station 17 and a first envelope feeding station 18. As the magazines pass the label feeding station 17 and the first envelope feeding station 18, either address labels are attached to the magazines or addressed envelopes are tipped to the magazines.

The conveyor 12 includes a plurality of guide pins 20 positioned to retain each of the magazines 14 in a known, registered position on the conveyor 12. Each magazine 14 has four guide pins 20 associated therewith that restrain the publication on the conveyor as they are carried toward a town sort station 16 in the direction of arrow 22.

For the purposes of description, it will be assumed that a plurality of envelopes, each containing a renewal notice letter, is to be tipped, one each, to certain of a plurality magazines carried by the conveyor 12 along the feed path 22. A plurality of presorted envelopes are carried by a tray 30 and are placed in an operative position with a second envelope feeding device 32. The envelopes in tray 30 each have subscriber information printed thereon including a subscriber's name, address, and zip code. The envelopes are presorted into geographic locations according to zip codes.

A controller 38 commands the second envelope feeding device 32 to feed the envelopes to an envelope storage tray 40. As the envelopes are individually fed from the second envelope feeding device 32 to the envelope storage tray 40, they pass through an envelope scanner station 44.

Each envelope includes machine readable geographic location indicia thereon. Geographic location indicia can take several forms such as a general description of a part of the country or a particular zip code. The purpose of using geographic location indicia is to presort the magazines prior to mailing so that a publisher can receive a reduced postal rate. For the purpose of clarity in explanation, a subscriber's geographic indicia will be the subscriber's zip code. The subscriber's zip code is on the envelope in human readable form and in machine readable form such as bar code. The envelope scanner station 44 generates an electric signal indicative of the zip code on each envelope. The zip code information for each envelope is stored in a first storage location of the controller 38. The number of envelopes that pass through the envelope scanner station 44 is stored in another storage location of the controller 38.

The envelope storage tray 40 stores the scanned envelopes in the order in which they were scanned. The envelope storage tray 40 is operatively positioned adjacent the first envelope feed station 18. The first envelope feed station 18 is a tipping apparatus of a type known in the art which will not be described herein in detail. Such tipping apparatus typically includes a suction device that removes a single envelope from a holding station, applies a small amount of glue to the edges of the envelope and feeds the envelope onto an article so that the envelope is lightly glued thereto. After receiving the article, the envelope can easily remove therefrom.

The envelope storage tray 40 in combination with the envelope feed station 18 utilizes a first-in-first-out (FIFO) inventory arrangement. Therefore, the envelope feed station 18 will tip envelopes onto the passing magazines in the order in which the envelopes were scanned by the envelope scanner station 44.

A conveyor position sensor 54 monitors a position indicating device 56 which is operatively connected to the conveyor 12. The envelope feed station 18 is operatively connected to the conveyor position sensor 54 to synchronize the feeding of envelopes from the envelope storage tray 40 onto a passing magazines 14 on the conveyor 12 which is retained in a known position by pins 20.

The controller 38 is operatively connected to the conveyor position sensor 54 so that the controller can monitor the position of the conveyor 12 at all times. The controller 38 is also operatively connected to a conveyor driver 60 which drives the conveyor 12 in the direction of arrow 22.

A labelling device 64 includes a plurality of preprinted labels 66 and a label scanning device 68. The label scanning device 68 is operatively connected to the controller 38. The labels 66 have subscriber information thereon including the subscriber's name, address and zip code. Subscriber information also includes mail piece attachment indicia indicating whether a subscriber is to receive a mail piece or not. When the labels 66 are printed, those subscribers targeted to receive a renewal letter have a mail piece attachment indicia on their labels indicating that subscriber is to receive a mail piece.

The mail piece attachment indicia can take one of many possible forms such as a bar coded marking on the label. Each label may include a mail piece attachment indicia which is read by the label scanner 68. The mail piece attachment indicia for a subscriber not receiving a mail piece will be different from that of a subscriber who is to receive a mail piece. Each label could include mail piece attachment indicia in code form indicating the exact date that a subscriber's subscription expires. The controller 38 can be programmed to interpret codes containing certain information to be indicative of those subscribers who are to receive a mail piece and those subscribers who are not to receive a mail peice. In this application, "the presence of a mail piece attachment mark" means the presence of mail piece attachment indicia that indicates that a subscriber is to receive a mail piece. The presence of mail piece attachment indicia indicating that a subscriber is not to receive a mail piece or the absence of a code altogether is referred to "as no mail piece attachment mark present."

As the labels are scanned by the label scanner 68, zip code information and the mail piece attachment indicia on the label is electrically outputted by the label scanner 68 to the controller 38. The controller reads and interprets the mail piece attachment indicia on the label and determines if a subscriber's label contains a mail piece attachment mark. If no mail piece attachment mark is present, the label is fed to the label feeding station 17 where it is applied to a next passing magazine 14. If a mail piece attachment mark is present, the controller may attach a mail piece to that magazine based on other determinations discussed below.

The label feeding station 17 is operatively connected to both the controller 38 and the conveyor position sensor 54. The construction of label feeding stations is known in the art and will not be described herein in detail. The label feeding station is synchronized with the movement of the conveyor 12 so that a label fed from the station 17 is applied to a known location on the next passing magazine. If a subscriber's label includes a mail piece attachment mark, the controller 38 activates a label extractor 70 which extracts the scanned label to a discarded label bin 72 so that no label is placed upon the next passing magazine.

Referring to FIG. 1, there is shown a plurality of magazines 14*a*, 14*b*, and 14*c* approaching the label feeding station 17 and envelope feeding station 18. The label that corresponds to magazine 14*d* did not include a mail piece attachment mark. Therefore, the label was attached to the magazine 14*d*. The label that corresponds with magazine 14*e* included a mail piece attachment mark. The label that corresponds with magazine 14*e* was extracted by the label extractor 70 and placed in a container 72 for discarded labels. The magazine 14*e* is to receive an envelope from the envelope feed station 18.

The label that coincided with magazine 14*f* did contain a mail piece attachment mark. As magazine 14*f* passed the first envelope feed station 18, an envelope was tipped thereto. The label that corresponded with magazine 14*g* did not contain mail piece attachment mark and therefore it received a label. The label that corresponded to magazine 14*h* did contain a mail piece attachment mark and therefore, that label was discarded and that magazine received a mail piece. The labels that corresponded with magazines 14*i* and 14*k* both did not contain a mail piece attachment mark and both received labels.

An error indicator 80 is operatively connected to the controller 38 and provides an error indication to the operator should an error, of the type discussed below, arise in the system operation.

Figure 2:
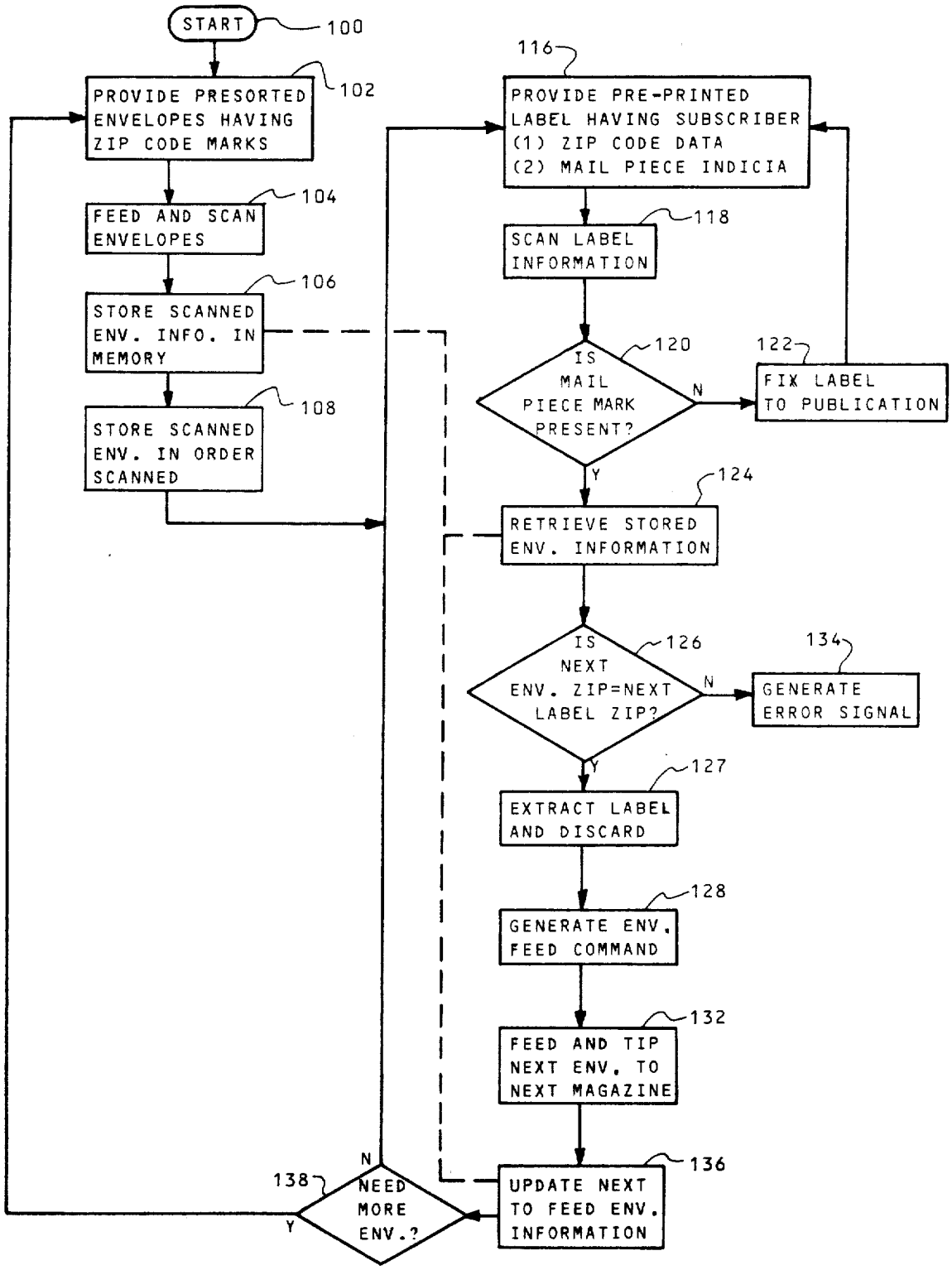
FIG. 2 is a flow diagram of a method for automatically tipping closely incidental mail to certain publications in accordance with the present invention.

Referring to the flow chart of FIG. 2, the details of the method of operation of the apparatus shown in FIG. 1 will be appreciated. Step 100 of the flow chart is an entry step for the method in accordance with the present invention. In step 102, a plurality of presorted envelopes having machine readable geographic indicia marks, such as zip codes, are provided. These envelopes are presorted into geographic locations and preferably into zip codes. In step 104, each of the envelopes is fed and scanned so that the zip code marks can be read. The scanned zip code information for each envelope is stored in a memory location of the controller in step 106. In step 108, the envelopes are stored in the order in which they were scanned.

Preprinted subscriber labels are provided in step 116. Each preprinted label includes zip code data and mail piece attachment indicia. The next to be fed label is scanned in step 118. A determination is made in step 120 whether mail piece attachment mark is present on a next to be fed label scanned in step 118, i.e., whether the mail piece attachment indicia indicates that subscriber is to receive a mail piece. If the result of the determination in step 120 is negative, the next to be fed label scanned in step 118 is fixed to the next passing magazine in step 122. As described above, the feeding of a label onto a passing magazine is synchronized with the advancement of the conveyor 12 so that the label is placed at a known location on the magazine retained between the guide pins 20.

If the result of the determination made in step 120 is affirmative, the information regarding the next to be fed envelope scanned in step 106 is retrieved in step 124. An inquiry is made in step 126 as to whether the next envelope to be fed has a zip code that is equivalent to the zip code of the subscriber label information of the next to be fed label scanned in step 118. If the zip codes are the same, the next to be fed label scanned in step 118 is extracted and discarded in step 127 and an envelope feed command is generated in step 128. After the feed command has been generated in step 128, the next to be fed envelope is tipped onto the magazine in step 132.

If the result of the inquiry in step 126 is negative, an error signal is generated in step 134 and the system is stopped. After an envelope is fed in step 132, the information on the next to be fed envelope is updated in step 136 from that information stored in step 106.

In step 138, an inquiry is made as to whether there is a sufficient supply of envelopes in the envelope storage tray connected to the envelope feed station. To make this determination, the controller compares the number of envelopes scanned in step 104 minus the number of envelopes tipped to passing magazines in step 132 with a predetermined number of envelopes desired to be maintained in the envelope storage tray 40. If the answer to the inquiry in step 138 is affirmative, the program returns to step 102 where more presorted envelopes are provided. If the inquiry of step 138 is negative, the program returns to step 116 where the next to be fed subscriber label is provided.

To better appreciate the operation of the invention an example is discussed, it being understood that this example is not meant to limit the scope of the invention. Assume that an envelope tray 30 of presorted envelopes contains 100 envelopes. The first 25 of these presorted envelopes all contain an identical zip code number and the remainder of the envelopes in the tray 30 have zip code numbers different from the zip code number of the first 25 envelopes. The controller commands the second envelope feeding device 32 to feed the envelopes from the presorted envelope tray 30 to the envelopes storage tray 40. As the envelopes pass through the envelope scanner station 44, the zip codes are scanned and an electrical signal is generated for each envelope indicative of the zip code on the envelope. The zip code information for each envelope is stored in the controller 38. The scanned envelopes are then stored in the envelope storage tray in the order that they were scanned. Assume that the labelling device 64 contains 5000 labels, the first 700 labels having the same zip code number as the first 25 envelopes now in the envelope storage tray 40 and the remainder of the labels have different zip code numbers from that contained on the first 25 envelopes. Assume, that of the first 700 subscribers which corresponds to the first 700 labels, 25 are to receive renewal letters. The labels for these 25 subscribers contain a mail piece attachment mark thereon. The mail piece attachment mark is a mail piece indicia indicating that subscriber is to receive a mail piece. As the magazines are fed by the conveyor 12 from a source location 15 to the town sort stack station 16 each magazine is to receive a label or an envelope.

The operation of the label feeding station 17 and the first envelope feeding station 18 is synchronized with the movement of the conveyor 12 to properly align the labels or envelopes with the magazines as they pass thereby, respectively. As each label 66 is fed through the label scanner 68, the scanner generates an electric signal indicative of the subscriber's zip code and the mail piece attachment indicia thereon. The information on the label is fed to the controller 38.

The controller 38 determines whether the mail piece attachment indicia on the scanned label indicates that subscriber is to receive a mail piece. Assume the first label scanned by the scanner 68 does not contain a mail piece attachment mark thereon. The controller then commands the label feed station 17 to feed the next to be fed label just scanned onto the magazine which coincides with that label as that magazine passes the label feeding station 17. This process continues for each label fed through the label scanner 68 individually.

Assume that the fifth label scanned by the scanner 68 does contain a mail piece attachment mark. The controller, at that point, compares the zip code on the label containing the mail piece attachment mark with the zip code of the next to be fed envelope in the envelope storage tray 40. If the zip codes are identical, the controller activates the label extractor 70 to extract the label containing the mail piece attachment mark and commands the first envelope feed station 18 to feed and tip the next envelope to be fed onto the magazine which coincides with that scanned label as that magazine passes thereby. If the zip code of the label containing the mail piece attachment mark is different from the zip code of the next to be fed envelope in the envelope storage tray 40, the controller would stop the system and activate the error indicator 80 so that the problem could be corrected by personnel.

Of the first 700 labels fed to the label scanner, 25 contained mail piece attachment marks. These labels are all extracted during the process and 25 envelopes having the same subscriber information thereon as the 25 labels are fed from the envelope storage tray 40 and tipped to the magazines passing onto the conveyor 12. It will be appreciated that there is no comparison of all subscriber information but only a comparison that the 25 labels containing the mail piece attachment marks have the same zip code of the 25 envelopes fed from the envelope feed station 18. The envelope being fed and tipped to a passing magazine may be for a subscriber different from the subscriber whose name and address is on the envelope tipped. However, when the process is completed, 25 magazines for the 25 subscribers to receive mail piece attachments will be tipped thereto. There is no need to have a one-to-one correspondence between the next label to be fed and the next envelope to be fed as long as the total number of envelopes tipped for a given zip code is equal to the number of labels containing a mail piece attachment mark for the same zip code.

It is preferable that the location of the placement of a label on a magazine coincide with the location of the placement of an envelope on the magazine. In this manner, if the label extractor should fail and a label having a mail piece attachment mark thereon should get fed onto a magazine, the envelope, when fed, would cover the label and the magazine will be mailed to the subscriber whose address is on the envelope.

Figure 3:
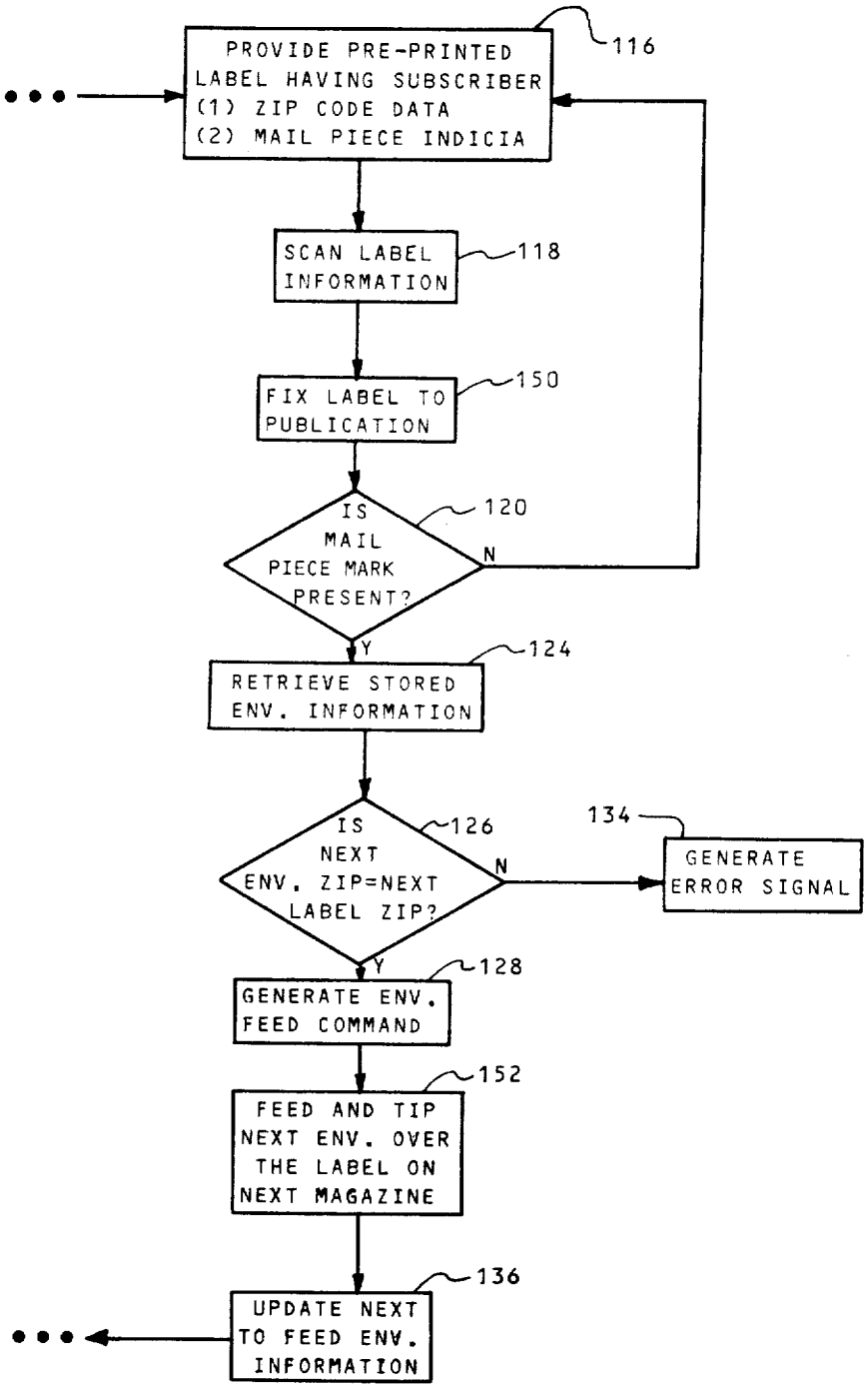
FIG. 3 is a flow diagram of another embodiment of the method in accordance with the present invention.

In another embodiment of the invention shown in the flow chart in FIG. 3, the operating method is substantially the same as that shown in FIG. 2 up to step 116. In step 116, as above, subscriber label information is provided including zip code data and mail piece attachment indicia. All previous steps before step 116 are identical to that shown in FIG. 2. The next step 118 is to feed and scan the label information on the next to be fed label. Step 150 fixes the label to the publication. In step 150, the label is fixed to the publication independent of whether a mail piece attachment mark is present. In step 120 a determination is made whether the subscriber label information provided in step 116 includes mail piece attachment mark. If the result of the determination in step 120 is negative, the program returns to step 116. If the result of the determination in step 120 is affirmative, the information for the next to feed envelope is retrieved from storage in step 124. A determination is made in step 126 as to whether the zip code for the next to be fed envelope is the same as the zip code for the label scanned in step 118. If the result of the determination in step 126 is negative, an error signal is generated in step 134. If the result of the determination in step 126 is affirmative, an envelope feed command is generated in step 128. In step 152, the next to be fed envelope is tipped over top of the label attached in step 150 to cover the information on the label. The information for the next to be fed envelope is then updated in step 136.

The embodiment of the invention shown in FIG. 3 eliminates (i) the need for a label extractor 70 and bin 72 shown in FIG. 1 and (ii) the need for a label extraction step 127 shown in FIG. 2. As described above in the example, the subscriber information i.e. the subscriber's name and address on the label fixed in step 150, will typically not be the same as the subscriber information on the envelope tipped over the top of the label in step 152. The zip codes however will be the same. Referring again to the above described example, the controller 38 is only concerned with tipping 25 envelopes to 25 magazines having the same zip codes as the 25 labels having mail piece attachment marks and is not concerned with matching the subscriber's names and addresses.

Figure 4:
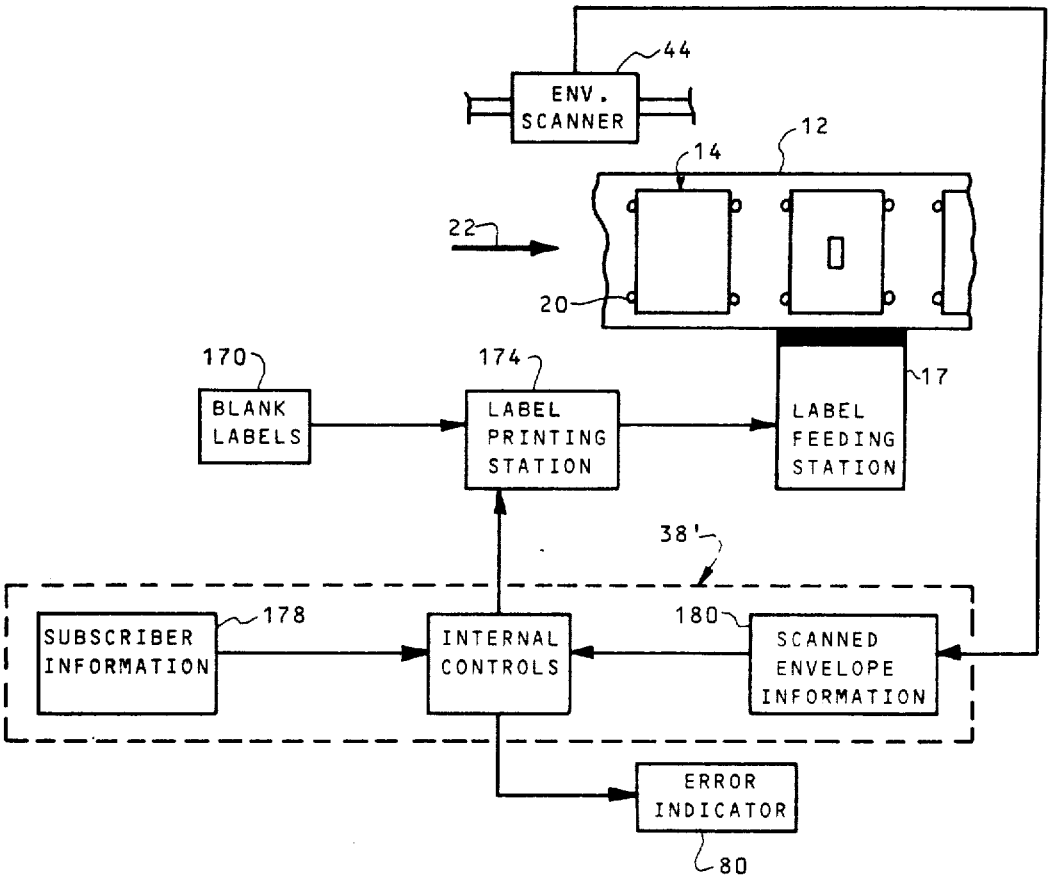
FIG. 4 is a schematic illustration of another embodiment of the apparatus in accordance with the present invention.

In another embodiment of the invention shown in FIG. 4, an apparatus is shown similar to that of FIG. 1 with a modification of the labelling station. A plurality of blank labels 170 are provided to a label printing station 174. The label printing station can take several forms including ink jet printing. A controller 38' includes all subscriber information contained in a memory location 178 including each subscriber's name, address, zip code and mail piece attachment indicia. The controller 38' is connected to the label printing station 174. Envelope information from an envelope scanner 44 is inputted to the controller 38' and stored in a memory location 180 for future use. As each magazine approaches the label feeding station 17 the controller retrieves the subscriber information from the memory location 178. The controller examines the subscriber information corresponding to the next magazine to be labelled and determines whether the information includes a mail piece attachment mark, i.e., whether the mail piece attachment indicia indicates that subscriber is to receive a mail piece. If the controller determines that no mail piece attachment mark is present for the retrieved subscriber information, the controller commands the label printing station 174 to print the subscriber information on the blank label. The printed label is then fed to the label feeding station 17 where it is fixed to the corresponding magazine passing thereby.

If the subscriber information retrieved from the memory location 178 for the next magazine to be labelled includes a mail piece attachment mark, the controller examines the scanned envelope information of the next to be fed envelope located in memory 180 to determine if the zip code of the next subscriber information for the next to be labelled magazine is the same as the zip code of the next to be fed envelope. If the zip code information matches, the controller does not print a label at the label printing station 174 but commands the envelope feeding station to tip the next to be fed envelope onto the corresponding magazine. If the zip codes do not match, an error indication 80 is given as described above with respect to the embodiment of FIG. 1.

It will be appreciated that the embodiment shown in FIG. 4 eliminates the need to have preprinted labels, a label scanner, a label extractor and a label extraction bin. In practice, the label printing station would be printing the labels at least one cycle ahead of the actual magazine passing the label feeding station 17. This would provide adequate time for the label printing station to print the label and to feed the printing label to the label feeding station 17 prior to feeding the label to the magazine.

Rather than providing a plurality of blank labels and printing the subscriber information on the blank labels, the subscriber information may be printed directly onto the passing magazine. In such an arrangement, the printing function would be synchronized with the movement of the conveyor and the blank labels and the label feeding station would be eliminated.

Figure 5:
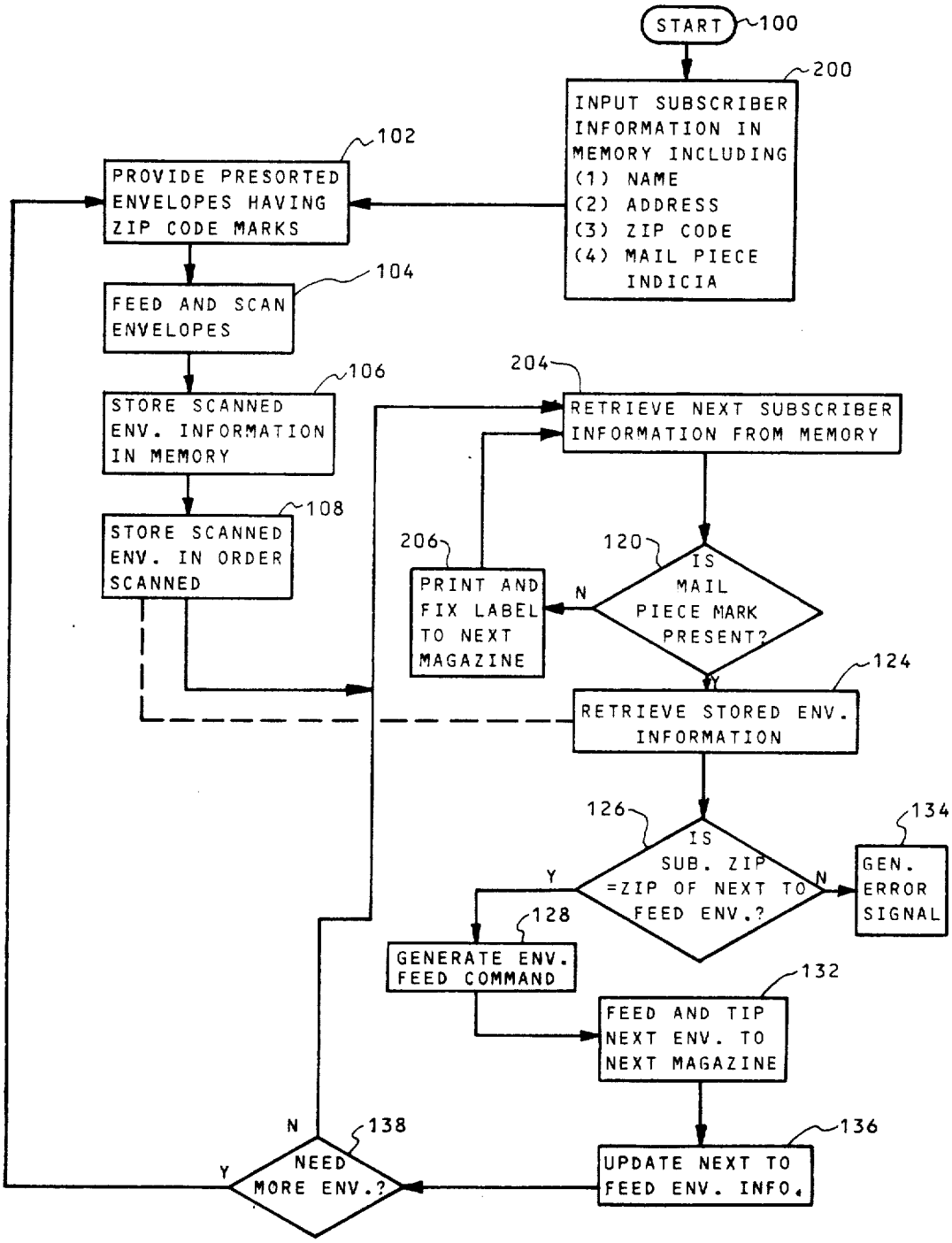
FIG. 5 is a flow diagram of yet another embodiment of the method in accordance with the present invention.

Referring to FIG. 5, a flow chart is shown and illustrates a method of operation utilizing the apparatus schematically depicted in FIG. 4. The program is initialized in step 100 and subscriber information is inputted in step 200 including the subscriber's name, address, zip code, and mail piece attachment indicia. Steps 102, 104, 106 and 108 are performed in a manner as described above with reference to the flow chart of FIG. 2. In step 204, the subscriber information for the next subscriber is retrieved from the information inputted in step 200. In step 120, a determination is made whether the subscriber information retrieved in step 204 includes a mail piece attachment mark. If the subscriber information does not include a mail piece attachment mark, a label is printed in step 206 and is affixed to the corresponding subscriber magazine. The program then returns to step 204 where the next subscriber's information is retrieved. If the inquiry in step 120 is in the affirmative, the stored envelope information is retrieved in step 124. Remaining steps 126, 132, 134, 136, and 138 are the same as described above with reference to FIG. 2. It will be appreciated that the flow chart of FIG. 5 eliminates the steps 118, 122 and step 127 from the method depicted in FIG. 2.

This invention has been described with reference to preferred embodiments. Modifications and alterations may occur to others upon reading and understanding the specification. It is my intention to include all such modifications and alterations insofar as they come within the scope of the appended claims or the equivalent thereof.

What is claimed is:

1. A method for automatically tipping mail pieces to certain magazines sequentially fed from a first location to a second location, said method comprising the steps of:

(a) sorting said mail pieces into groups according to geographic regions, each mail piece having machine readable geographic information thereon;

(b) sorting subscriber labelling information into groups according to geographic regions, said subscriber labelling information including machine readable geographic information and mail piece attachment indicia indicating whether a subscriber is to receive a mail piece;

(c) machine scanning subscriber labelling information corresponding to each magazine fed from the first location to the second location;

(d) generating a signal in response to the scanning mail piece attachment indicia indicating the subscriber is to receive a mail piece on the subscriber labelling information;

(e) automatically transferring at least some of said subscriber labelling information to selected some of said magazines feeding from the first location to the second location in response to said signal;

(f) automatically actuating tipping means for attaching mail pieces to selected others of said magazines fed from the first location to the second location in response to said signal.

2. The method of claim 18 wherein the step of generating a signal further includes the step of scanning the next to be fed label to determine whether the geographic information of a next to feed mail piece is the same as geographic information of subscriber labelling information determined to include mail piece attachment indicia indicating that subscriber is to receive a mail piece.

3. The method of claim 2 further including the steps of:

(a) automatically actuating disable means to prevent the transfer of subscriber labelling information to publications when the subscriber labelling information is determined to include mail piece attachment indicia indicating that subscriber is to receive a mail piece; and (b) automatically actuating said tipping means to prevent the attachment of mail pieces to publications when the subscriber information is determined to not include mail piece attachment indicia indicating that subscriber is to receive a mail piece.

4. An apparatus for tipping a selected mail piece of a plurality of mail pieces to a selected magazine of a plurality of magazines, each mail piece including a subscriber's name, address and geographic indicia, said apparatus comprising:

transporting means for sequentially transporting said plurality of magazines from a first location to a second location;

a controller;

first input means for inputting the geographic indicia of said selected mail piece to said controller;

second input means for sequentially providing subscriber information to said controller for each of a plurality of subscribers including geographic indicia and mail piece attachment indicia, said mail piece attachment indicia indicative of whether a subscriber is to receive a mail piece;

labelling means disposed between said first and said second locations for selectively applying a subscriber's name, address and geographic indicia to a magazine being transported;

said controller including determining means for determining if said subscriber information inputted to said controller by said second input means includes mail piece attachment indicia indicating a subscriber is to receive a mail piece for each subscriber of said plurality of said subscribers, comparing means for comparing geographic indicia of subscriber information determined to include mail piece attachment indicia indicating a subscriber is to receive a mail piece with geographic indicia of said selected mail piece, and generating means for generating a mail piece feed signal when geographic indicia compared by said comparing means coincide; and tipping means for tipping said mail piece to a selected magazine responsive to said mail piece feed signal from said generating means of said controller.

5. The apparatus of claim 4 further including labelling disable means for preventing said labelling means from applying a subscriber's name, address and geographic indicia to a magazine when said subscriber information is determined to include mail piece attachment indicia indicative of a subscriber is to receive a mail piece.

6. The apparatus of claim 5 wherein said labelling means includes a plurality of preprinted labels, each label having a subscriber's name, address, geographic indicia and mail piece attachment indicia thereon, and wherein said second input means includes an electronic scanning means for scanning each label and for inputting said geographic indicia and mail piece attachment indicia to said controller.

7. The apparatus of claim 6 wherein said labelling disable means includes a label extractor for discarding a scanned label when activated, said controller activating said label extractor when said mail piece attachment indicia is determined to indicate that the subscriber is to receive a mail piece.

8. The apparatus of claim 5 wherein said labelling means includes a printing means.

9. The apparatus of claim 8 wherein said labelling disable means includes means for disabling said printing means when said subscriber information is determined to include mail piece attachment indicia indicating a subscriber is to receive a mail piece.

10. The apparatus of claim 5 wherein said apparatus further includes means to maintain each magazine on said transport means in a known position, said labelling means including timing means to position a subscriber's name, address and geographic indicia, when applied, at a known location on a magazine and wherein said tipping means includes timing means to position a mail piece, when tipped, to a magazine at said known location.

11. An apparatus for applying mailing information to a plurality of magazines of a common zip code, said apparatus comprising:

transporting means for sequentially transporting said plurality of magazines from a first location to a second location;

labelling means for applying labelling information to selected ones of said plurality of magazines;

tipping means for applying preaddressed mail pieces to selected others of said plurality of magazines;

means for determining which of said plurality of magazines are to receive a preaddressed mail piece, said tipping means applying a preaddressed mail piece to a magazine responsive to said determining means; and label disabling means for preventing application of labelling information to a magazine when said determining means determines a magazine is to receive a preaddressed mail piece.

12. The apparatus of claim 11 further including timing means for controlling application of labelling information to magazines and application of mail pieces to magazines being transported to have a location of labelling information on a magazine, when applied, coincide with the location of a mail piece on a magazine, when applied.

13. The apparatus of claim 11 wherein said labelling means includes a plurality of preprinted labels including each subscriber's name, address, zip code and mail piece attachment indicia, said apparatus further including a label scanner for scanning each label and feeding the zip code and mail piece attachment indicia to said determining means for each label scanned.

14. The apparatus of claim 13 wherein said label disabling means is a label extractor to discard labels when activated, said determining means activating said label extractor when said determining means determines a magazine is to receive a preaddressed mail piece.

15. The apparatus of claim 13 further including a mail piece scanner for scanning the zip code on each mail piece and wherein said determining means includes a controller, said controller comparing the zip code of a label having mail piece attachment indicia indicating a subscriber is to receive a mail piece with the zip code on a next mail piece to be tipped, said controller generating a mail piece feed command to said tipping means if compared zip codes coincide and generating an error signal if compared zip codes do not coincide.

16. The apparatus of claim 11 wherein said labelling means includes a printing means and said determining means includes a controller having a memory means containing each subscriber's name, address, zip code and mail piece indicia.

17. The apparatus of claim 16 wherein said label disabling means prevents printing of labelling information responsive to said determining means.

* * * * *

UNITED STATES PATENT AND TRADEMARK OFFICE

CERTIFICATE OF CORRECTION

PATENT NO. : 4,576,370

DATED : March 18, 1986

INVENTOR(S) : Dale H. Jackson

It is certified that error appears in the above-identified patent and that said Letters Patent is hereby corrected as shown below:

Column 11, line 29 change "18" to -- 1 --.

Signed and Sealed this

*Fifth* Day of *August 1986*

[SEAL]

*Attest:*

DONALD J. QUIGG

*Attesting Officer*

*Commissioner of Patents and Trademarks*